US012011124B1

(12) United States Patent
Thompson et al.

(10) Patent No.: US 12,011,124 B1
(45) Date of Patent: Jun. 18, 2024

(54) FLUSHABLE LINER FOR USE IN TOILET SYSTEMS

(71) Applicants: Lisa Thompson, Bunn, NC (US); James Thompson, Bunn, NC (US)

(72) Inventors: Lisa Thompson, Bunn, NC (US); James Thompson, Bunn, NC (US)

( * ) Notice: Subject to any disclaimer, the term of this patent is extended or adjusted under 35 U.S.C. 154(b) by 0 days.

(21) Appl. No.: 18/425,848

(22) Filed: Jan. 29, 2024

(51) Int. Cl.
*A47K 11/10* (2006.01)

(52) U.S. Cl.
CPC ..... *A47K 11/105* (2013.01)

(58) Field of Classification Search
CPC ..... A47K 11/105
USPC ..... 4/315, 300, 321
See application file for complete search history.

(56) References Cited

U.S. PATENT DOCUMENTS 3,587,116 A * 6/1971 Quase ..... E03F 5/22 4/300
4,152,792 A * 5/1979 Glintz ..... A61G 7/0005 4/452
5,359,737 A * 11/1994 Hodge ..... A47K 11/04 4/476
D376,196 S * 12/1996 Segel ..... D23/313
5,778,458 A * 7/1998 Speelman ..... A47K 11/105 4/451
5,903,932 A * 5/1999 Whitesel ..... A47K 11/105 4/476
6,058,520 A * 5/2000 Hawkins ..... A47K 11/105 4/484
6,081,937 A * 7/2000 Whitacre ..... E03D 9/00 4/300.3
6,532,605 B1 * 3/2003 Howell ..... A47K 11/105 383/77
D472,620 S * 4/2003 Phillips ..... D23/309
6,564,399 B1 * 5/2003 Teal ..... A47K 11/105 4/300.3
6,694,535 B1 * 2/2004 Gianesi Gschwind ..... A47K 11/105 4/245.3
6,738,991 B1 * 5/2004 Dandreo ..... A47K 11/06 4/484
9,487,939 B1 * 11/2016 Cook ..... E03D 9/00
2003/0121097 A1 * 7/2003 Sherrod ..... B32B 27/08 4/661
2003/0159207 A1 * 8/2003 Howell ..... A61G 9/003 4/484
2004/0158918 A1 * 8/2004 Lopes ..... A47K 11/06 4/484
2004/0166289 A1 * 8/2004 Troutman ..... B32B 27/12 428/157

(Continued)

FOREIGN PATENT DOCUMENTS

GB 2224522 A * 5/1990 ..... A47K 11/06
WO WO-9949770 A1 * 10/1999 ..... A47K 11/105

*Primary Examiner* — Lori L Baker
(74) *Attorney, Agent, or Firm* — Ashley D. Johnson; Dogwood Patent and Trademark Law

(57) ABSTRACT

The invention is for liners provided for use in a flush toilet with an interior. The liners are configured to fit within the interior area of the toilet bowl to contact an upper surface of the toilet water. The liners prevent soiling of the interior of the toilet bowl and facilitate the efficient removal and flushing of human waste. The liner acts as a barrier between the toilet bowl and wastewater, whereby the liner can then be flushed along with the contents of the bowl, thereby extending the period between necessary cleanings.

20 Claims, 7 Drawing Sheets

(56) References Cited

U.S. PATENT DOCUMENTS

| | | | | |
|---|---|---|---|---|
| 2006/0272082 | A1* | 12/2006 | Schega | A47K 11/105 4/484 |
| 2009/0113613 | A1* | 5/2009 | Kole | A47K 11/105 4/300.3 |
| 2009/0158514 | A1* | 6/2009 | Doctors | A47K 11/105 4/300.3 |
| 2012/0102636 | A1* | 5/2012 | West | A47K 11/06 4/479 |
| 2013/0139311 | A1* | 6/2013 | Shaw | A47K 11/02 4/479 |
| 2015/0182405 | A1* | 7/2015 | Gradov | A61G 9/003 4/452 |
| 2016/0302630 | A1* | 10/2016 | Campbell | A47K 11/105 |
| 2021/0282606 | A1* | 9/2021 | Mulligan | A47K 13/16 |

* cited by examiner

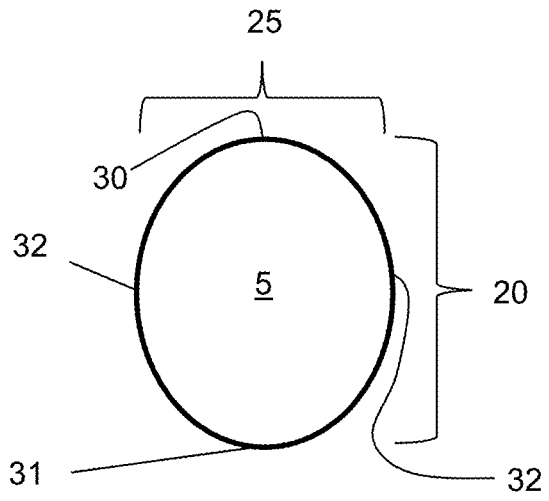
Fig. 3a
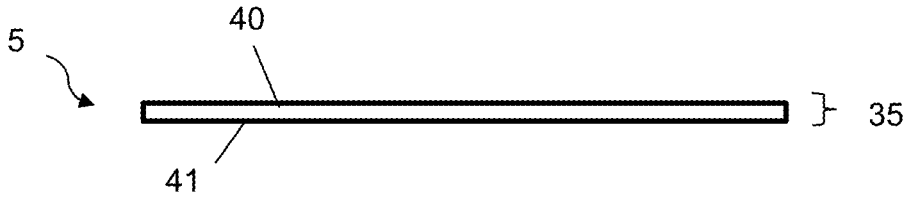
Fig. 3b
Fig. 4
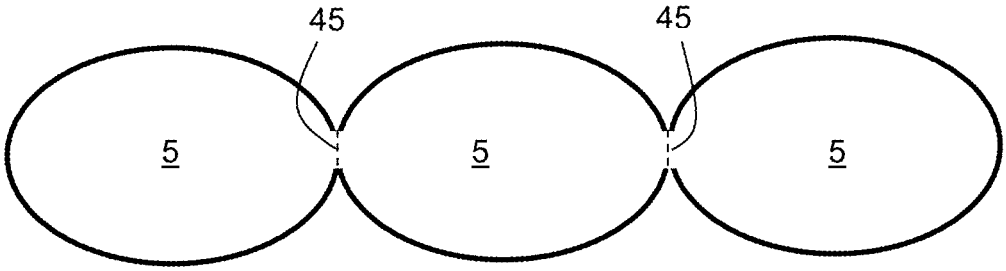

FLUSHABLE LINER FOR USE IN TOILET SYSTEMS

TECHNICAL FIELD

The presently disclosed subject matter relates generally to flushable liners for use in toilets and other waste elimination devices. As discussed in detail, the liners facilitate cleaner, more hygienic disposal of human waste.

BACKGROUND

Prior art disposable toilet bowl protectors are known in the art. Most of the prior art bowl protectors, however, are directed towards protecting a user from direct contact with the seat portion of a toilet. Thus, conventional toilet coverings do not protect the toilet bowl from solid waste residue. Further, commonly used toilet bowl protectors fail to reduce noise and eliminate or mask odor. Toilet seat covers also do not resolve the problem of providing cleaner flushing of human waste to avoid soiling of the toilet bowl, splashing of waste on the seat for the next user, and/or requiring multiple flushes to remove stains left behind on the toilet bowl. To this end, toilet bowls need to be cleaned regularly to maintain their cleanliness and proper operation. This involves cleaning the interior of the toilet bowl using cleaning products and tools. While toilet bowl cleaning is commonplace for both residential and public toilets, the process can be time consuming and burdensome. It would therefore be beneficial to provide a system of maintaining the cleanliness of toilet bowls for extended periods between cleanings. It would be further beneficial if the system prevented direct contact between human waste and the toilet bowl interior to further improve cleanliness.

SUMMARY

In some embodiments, the presently disclosed subject matter is directed to a liner for preventing waste from contacting an interior surface of a toilet bowl. Particularly, the liner comprises a sheet of flushable and biodegradable material defined by a top surface and an opposed bottom surface with an outer circumference extending about the sheet. The term "outer circumference" refers to an edge about the outside edge of the liner (e.g., the outer perimeter).

In some embodiments, the liner is constructed from one or more materials selected from cellulosic fibers, rayon, polyolefin, polyester, polyamide, polyaramid, polyol, polyether, polyether polyol, cotton, wood pulp, tissue, creped cellulose wadding, meltblown polymers, absorbent foams, absorbent sponges, and superabsorbent polymers.

In some embodiments, the liner comprises one or more odor-absorbing agents selected from baking soda, charcoal, or combinations thereof.

In some embodiments, the liner includes one or more scenting agents configured to mask odors.

In some embodiments, the liner is configured in a round or oval shape.

In some embodiments, the liner comprises a length of about 5-15 inches, a width of about 5-15 inches, and a thickness of about 0.001-0.1 inches.

In some embodiments, the liner further includes a plurality of pleats that extend around the outer circumference.

The liner includes an extension arm that extends away from a main portion of the liner, the extension arm including a distal end comprising adhesive. The extension arm can have a length of about 5-15 inches. The liner can optionally further include a ring of adhesive positioned about the outer circumference and/or a thickened region with a thickness greater than the remainder of the liner.

In some embodiments, the liner includes a ring of adhesive positioned about the outer circumference.

In some embodiments, a central region of the bottom face comprises a thickened region with a thickness greater than the remainder of the liner.

In some embodiments, the presently disclosed subject matter is directed to a method of reducing or preventing staining of an interior of a toilet bowl. Particularly, the method comprises depositing the disclosed liner within the interior of the toilet bowl such that the liner contacts a volume of water within the toilet bowl interior. The method includes depositing a volume of human waste within the toilet bowl interior such that the waste contacts the top surface of the liner. The liner wraps around the human waste and prevents direct contact between the human waste and the toilet bowl interior. The method includes flushing the toilet, wherein the liner and the waste are flushed. The interior of the toilet bowl has reduced or no staining from the human waste.

In some embodiments, the liner emits a fragrance when contacting the volume of water within the toilet bowl interior.

In some embodiments, the liner initially floats on the top of the volume of water and after a period of time, sinks beneath a surface of the water.

In some embodiments, the presently disclosed subject matter includes a dispensing container comprising a plurality of the disclosed liners.

BRIEF DESCRIPTION OF THE DRAWINGS

FIG. 3*a* is a top plan view of a liner in accordance with some embodiments of the presently disclosed subject matter.

FIG. 3*b* is a side plan view of a liner in accordance with some embodiments of the presently disclosed subject matter.

FIG. 4 is a top plan view of a series of connected liners in accordance with some embodiments of the presently disclosed subject matter.

DETAILED DESCRIPTION

Figure 1A:
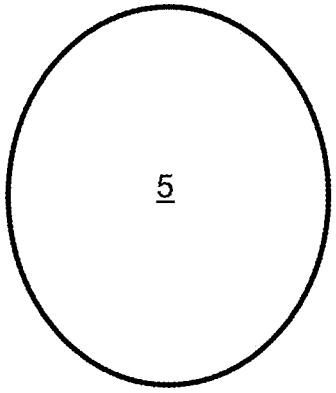
FIG. 1*a* is a top plan view of a liner in accordance with some embodiments of the presently disclosed subject matter.

The presently disclosed subject matter is introduced with sufficient details to provide an understanding of one or more particular embodiments of broader inventive subject matters. The descriptions expound upon and exemplify features of those embodiments without limiting the inventive subject matters to the explicitly described embodiments and features. Considerations in view of these descriptions will likely give rise to additional and similar embodiments and features without departing from the scope of the presently disclosed subject matter.

Unless defined otherwise, all technical and scientific terms used herein have the same meaning as commonly understood to one of ordinary skill in the art to which the presently disclosed subject matter pertains. Although any methods, devices, and materials similar or equivalent to those described herein can be used in the practice or testing of the presently disclosed subject matter, representative methods, devices, and materials are now described.

Following long-standing patent law convention, the terms "a", "an", and "the" refer to "one or more" when used in the subject specification, including the claims. Thus, for example, reference to "a device" can include a plurality of such devices, and so forth. It will be further understood that the terms "comprises," "comprising," "includes," and/or "including" when used herein specify the presence of stated features, integers, steps, operations, elements, and/or components, but do not preclude the presence or addition of one or more other features, integers, steps, operations, elements, components, and/or groups thereof.

Unless otherwise indicated, all numbers expressing quantities of components, conditions, and so forth used in the specification and claims are to be understood as being modified in all instances by the term "about". Accordingly, unless indicated to the contrary, the numerical parameters set forth in the instant specification and attached claims are approximations that can vary depending upon the desired properties sought to be obtained by the presently disclosed subject matter.

As used herein, the term "about", when referring to a value or to an amount of mass, weight, time, volume, concentration, and/or percentage can encompass variations of, in some embodiments +/−20%, in some embodiments +/−10%, in some embodiments +/−5%, in some embodiments +/−1%, in some embodiments +/−0.5%, and in some embodiments +/−0.1%, from the specified amount, as such variations are appropriate in the disclosed packages and methods.

As used herein, the term "and/or" includes any and all combinations of one or more of the associated listed items.

Relative terms such as "below" or "above" or "upper" or "lower" or "horizontal" or "vertical" may be used herein to describe a relationship of one element, layer, or region to another element, layer, or region as illustrated in the drawing figures. It will be understood that these terms and those discussed above are intended to encompass different orientations of the device in addition to the orientation depicted in the drawing figures.

The embodiments set forth below represent the necessary information to enable those skilled in the art to practice the embodiments and illustrate the best mode of practicing the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

The presently disclosed subject matter is directed to a liner that is inserted into the interior of a toilet bowl to provide a barrier between human waste and the interior of the toilet bowl. The term "liner" generally refers to a thin and flexible sheet suitable for placement in contact with the interior of a toilet bowl and/or toilet water. The liner prevents the accumulation of residue on the interior surfaces of the toilet bowl, thereby requiring less cleaning over a given period of time. Thus, the liners easily and effectively reduce or eliminate stains from toilets due to human waste.

Figure 1B:
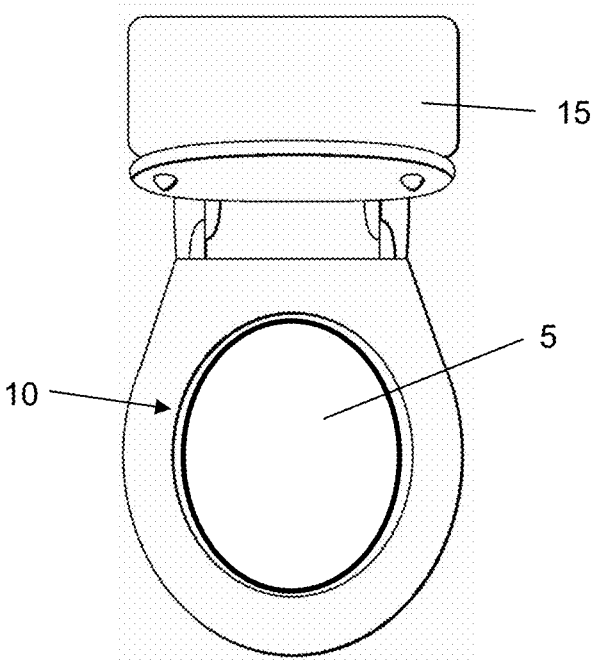
FIG. 1*b* is a top plan view of a toilet bowl with applied liner in accordance with some embodiments of the presently disclosed subject matter.
Figure 1C:
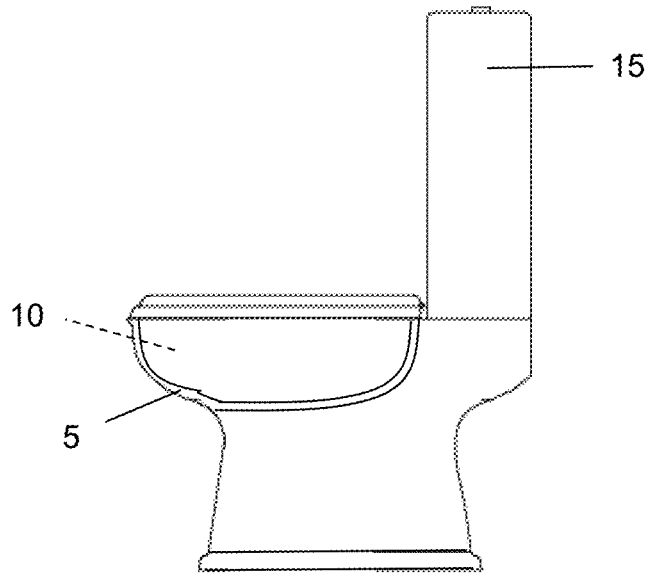
FIG. 1*c* is a side plan view of a toilet bowl with applied liner in accordance with some embodiments of the presently disclosed subject matter.

As illustrated in FIGS. 1*a*-1*c*, liner 5 is sized and shaped to fit within interior 10 of toilet bowl 15. In some embodiments, the liner is absorbent and sinks to cover the interior of the toilet bowl, as discussed in detail below. In other embodiments, the liner floats on the top surface of the water and sinks once waste contacts the liner. In use, a user will apply liner 5 to the toilet bowl interior prior to using the bathroom. The liner will then catch and hold any waste, preventing the waste from touching and staining the toilet bowl interior. Thus, once in place, the liner acts as a physical barrier between the walls of the toilet interior and human waste, preventing deposits from accumulating along the walls of the toilet bowl. The liner and any captured waste are then flushed down the toilet, leaving no stains remaining on the toilet bowl interior. Disposable liner 5 therefore maintains the cleanliness of the toilet bowl over long periods of time. As a result, the period between toilet bowl cleanings is extended and toilet maintenance costs are reduced.

As noted above, the invention includes liner 5 that is placed within the interior of the toilet bowl. The liner can be constructed from any suitable material that is approved for septic use. For example, liner 5 can be formed from materials already used for disposable toilet seat covers (although the liner is not limited to these materials). Liner 5 can include a fiber matrix comprising cellulosic fibers (such as cellulose or various alkylated cellulose materials such as methyl cellulose, ethyl cellulose and the like), wherein the fibers are connected and/or bonded in the matrix using an adhesive that dissolves and/or disperses in water after a period of time and/or after flushing is complete. Fibers that may be used for such degradable tissue-like sheets may be formed of dissolvable loosely woven or nonwoven fabric matrices formed of polymeric materials such as rayon, polyolefins (polypropylene, polyethylene and copolymers thereof) polyesters, polyamides, polyaramids, polyols, polyethers, polyester polyols, and the like, as well as copolymers, mixtures and derivatives of these polymers. Any of the noted materials may be used alone or in combination and/or any other conventional flushable materials (e.g., cotton, tissue wraps, tissue laminates, comminuted wood pulp, creped cellulose wadding, meltblown polymers, cellulosic fibers, absorbent foams, absorbent sponges, superabsorbent polymers, absorbent gelling materials, and combinations thereof). Such disposable and flushable materials are available in various forms and are known in the field of toilet liners, disposable commode and potty-chair liners, diapers, and feminine napkins.

The term "cellulosic fibers" refers to fibers made with ethers or esters of cellulose, which can be obtained from the bark, wood or leaves of plants, or from other plant-based material (optionally with the inclusion of hemicellulose and lignin, with different percentages of these components altering the mechanical properties of the fibers). The term "rayon" refers to manufactured cellulosic fibers made from regenerated cellulose. The term "polyolefin" refers to a homopolymer or a copolymer made from a linear or branched, cyclic or acyclic alkene. The term "polyester" refers to a polymer that includes an ester functional group in the main chain. The term "polyamide" refers to polymers and copolymers comprising repeating units containing amide groups. The term "polyaramid" or "aromatic polyamide" refers to aromatic rings of six carbon atoms connected via amide linkages each comprising a CO group attached to an NH group. The term "polyol" refers to a molecule that has an average of greater than 1.0 hydroxyl groups per molecule. The term "polyether" refers to a divalent radical the includes a plurality of, i.e., at least two, ether groups, where an ether group has the formula R—O—R and R represents alkylene groups and O represents oxygen. The term "polyether polyol" refers to a molecule that includes a polyoxyalkylene (e.g., polyether) chain and one or more terminal hydroxyl groups. The term "cotton" refers to plants, seeds, or plant cells of the genus *Gossypium*. The term "wood pulp" refers to natural cellulose fibers that are derived from wood. The term "tissue" refers to a soft, low density web (i.e., a basis weight <of about 0.15 $g/cm^3$) useful as a cleaning implement for post-urination and post-defecation hygiene (toilet paper). The term "creped cellulosic wadding" refers to non-woven material that is primarily composed of cellulose fibers. The term "meltblown polymer" refers to a polymer produced via meltblown process wherein fibrous webs or articles are constructed directly from polymers or resins using high-velocity air or another appropriate force to attenuate the filaments. The term "absorbent" refers to the characteristic of absorbing or removing moisture or humidity that is flowing in from the outside by physical or chemical reaction. The term "absorbent foam" refers to foam (substances formed by trapping pockets of gas or air in a liquid or solid) with absorbent characteristics. The term "absorbent sponge" refers to a porous structure with absorbent characteristics. The term "superabsorbent polymer" refers to a water-swellable, water-insoluble, organic or inorganic material, including superabsorbent polymers and superabsorbent polymer compositions, capable of absorbing at least about 10 times its weight.

Optional water resistant, but dissolvable and biodegradable films may also be applied to form a laminated structure if desired. The liners can be formed with sufficient structural integrity to float on top of the water for a predetermined time (e.g., 30 seconds, 1 minute, 5 minutes, 10 minutes, 30 minutes, etc.) and to hold and wrap around human waste prior to flushing to help avoid soiling of the toilet bowl and efficient flushing of human waste, even in circumstances where water levels and/or water pressure are lower than normal.

In some embodiments, the materials selected for use in liner 5 have a slower rate of breakdown when compared to toilet tissue, allowing the liner to maintain its structure for a period of time while deployed in the toilet bowl water and while in use. In particular, liner 5 can be adapted to be placed into the toilet bowl water and maintain its structure for several minutes without biodegrading, thereby acting as a physical barrier between the walls of the toilet bowl and the water therein. When flushed, the liner continues to break down and eventually separates and dissolves to the extent it does not interfere with septic or sewer systems. However, it is noted that this is an optional feature that may not be present in all liners.

Liner 5 can include one or more optional additives, such as (but not limited to) water-absorbing materials (polyacrylates and copolymers thereof), strengthening fibers or powder fillers, odor-absorbing agents (such as baking soda, charcoal, and the like), perfuming or scenting agents (to mask undesirable odors), bowl cleaning agents (such as chlorine or bleach), microbiocidal or germicidal agents, and pigments and/or dyes to provide color.

Optionally, liner 5 can include decorative designs or patterns included on at least the central portion of the liner or on the entire liner surface (on one or both sides). The decorative patterns can make the liner more attractive for use by children (including novelty characters and the like) and/or for providing the liners as novelty items for users (e.g., incorporating comical and/or entertaining images).

It should be appreciated that liner 5 is constructed from one or more flushable and/or biodegradable materials. The term "flushable" refers to the ability of a material, when flushed, to clear the toilet, trap, and the drain lines leading to the municipal wastewater conveyance system. The term "biodegradable" refers to a material that degrades from the action of naturally occurring microorganisms, such as bacteria or fungi. Liner 5 therefore comprises water soluble material to convey a flushable characteristic, allowing the liner to biodegrade in wastewater in the same manner as toilet paper and other flushable products.

In some embodiments, liner 5 can be flexible (e.g., can easily flex or bend). The flexibility of the liner allows the liner to deform as necessary to accommodate various shapes and depths of toilet bowls.

Figure 2A:
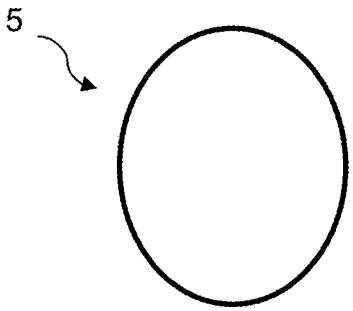
FIGS. 2*a* and 2*b* are top plan view of liners in accordance with some embodiments of the presently disclosed subject matter.
Figure 2B:
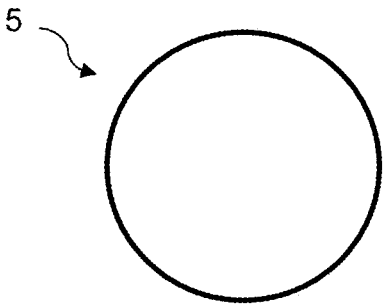

Liner 5 can be constructed in any suitable shape, such as (but not limited to) oval or circular, as shown in FIGS. 2*a* and 2*b*. For example, it may be advantageous to have the sheet mimic the actual or approximate shape of toilet interior 10. However, the shape of the liner is not limited and can be constructed in any desired shape, such as square, rectangular, triangular, pentagonal, octagonal, and the like. Any shape can be used.

The liner can be constructed in any suitable size. For example, the liner can be configured to closely match the cross-sectional size of the interior of a toilet bowl. Thus, liner 5 can include length 20 and/or width 25 of about 5-15 inches (e.g., at least/no more than about 5, 6, 7, 8, 9, 10, 11, 12, 13, 14, or 15 inches), as illustrated in FIG. 3*a*. The term "length" refers to the longest vertical distance of the liner (e.g., from top edge 30 to bottom edge 31 of the liner). The term "width" refers to the longest horizontal distance of the liner (e.g., the longest straight-line distance between side edges 32). Liner 5 can include thickness 35 of about 0.001-0.1 inch in some embodiments (e.g., at least/no more than about 0.001, 0.005, 0.01, 0.05, or 0.1 inches), as illustrated in FIG. 3*b*. The term "thickness" refers to the distance between top and bottom faces 40, 41 of the liner, as shown. The bottom face of the liner is the face positioned closest to the bottom of the toilet bowl interior bottom. The top face of the liner is the face positioned opposite to the bottom face, and upwards away from the toilet bowl interior. While the description above provides a range of configurations and dimensions, it should be understood that the size and configuration of the liner can be varied to accommodate various toilet bowl configurations and/or for manufacturing convenience.

In some embodiments, each liner can be individually packaged as a single use item. In other embodiments, adjacent liners can be attached using transverse lines of perforation 45, as shown in FIG. 4. The term "perforation" refers to the point of separation between individual liners. Thus, in use a user would simply apply light pressure to one liner, thereby separating it from the others for use. The liners are not limited to perforations and any conventional method of attaching adjacent liners together can be used.

Figure 5:
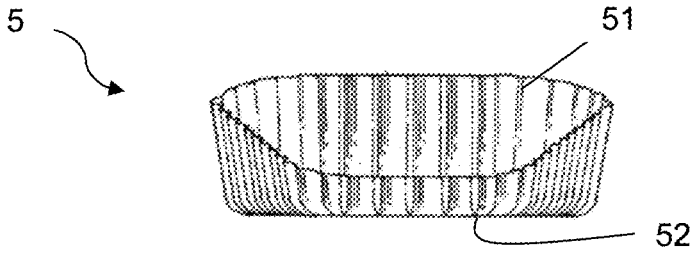
FIG. 5 is a front plan view of a liner comprising pleats in accordance with some embodiments of the presently disclosed subject matter.

Liner 5 can also include various optional features. For example, in some embodiments, the liner can include sidewall 50 comprising a series of pleats 51 that lie in contact with the sides of the toilet interior, as shown in FIG. 5. The sidewall can be uniform or non-uniform as it extends upward from the bottom face of the liner. The term "pleats" refers to a relatively flat double-fold formed in the liner material. The pleats allow for easy unfolding of the liner once positioned within the toilet bowl interior, thereby maximizing coverage of the liner. Bottom face 52 of this liner embodiment can be planar or flat to ensure that any waste is adequately captured. It should be appreciated that pleats 51 are optional.

Figure 6A:
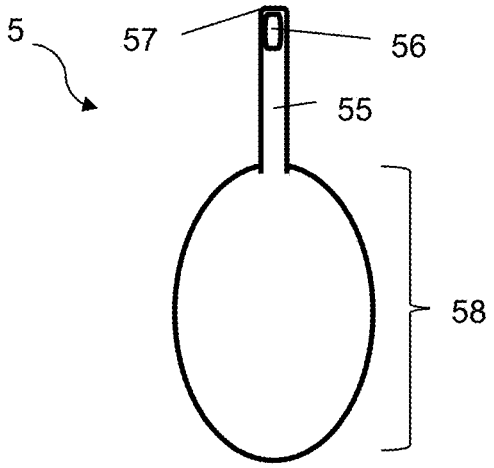
FIG. 6*a* is a top plan view of a liner comprising an extension in accordance with some embodiments of the presently disclosed subject matter.
Figure 6B:
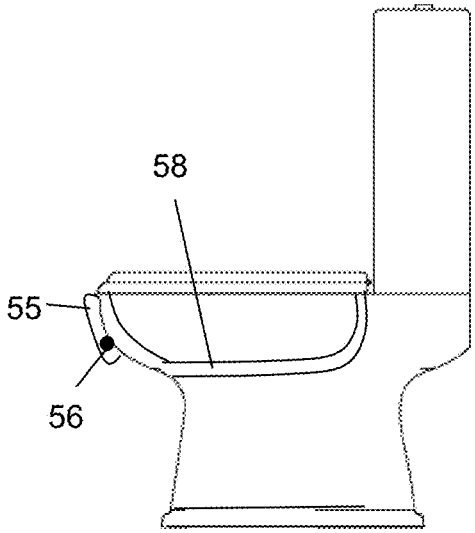
FIG. 6*b* is a side plan view of a toilet comprising the liner of FIG. 6*a* in accordance with some embodiments of the presently disclosed subject matter.

In other embodiments, the liner can include extension 55 used to retain the liner in proper position within the toilet bowl interior. As shown in FIG. 6*a*, the extension can be configured as one or more arms with a portion of adhesive 56 positioned at distal end 57. Extension 55 can have length of about 5-15 inches (e.g., at least/no more than about 5, 6, 7, 8, 9, 10, 11, 12, 13, 14, or 15). The length of the extension is defined as the distance between the main body 58 and the distal end 57. As shown in FIG. 6*b*, the arm is placed on the front of the toilet such that a user can confirm when the liner is properly positioned. The remainer of the arm and the main body of the liner are housed within the interior of the toilet bowl. Thus, only the distal region of the extension extends over or under the toilet seat to the front of the toilet bowl exterior. The reminder of the liner remains within the interior of the toilet. The action of the toilet flushing dislodges adhesive 56, allowing the liner (including extension 55) and any waste to be flushed down the toilet. It should be appreciated that extension 55 is an optional feature.

Figure 7A:
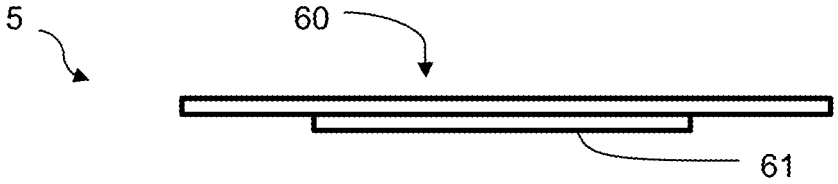
FIG. 7*a* is a side plan view of a liner comprising a thickened region in accordance with some embodiments of the presently disclosed subject matter.
Figure 7B:
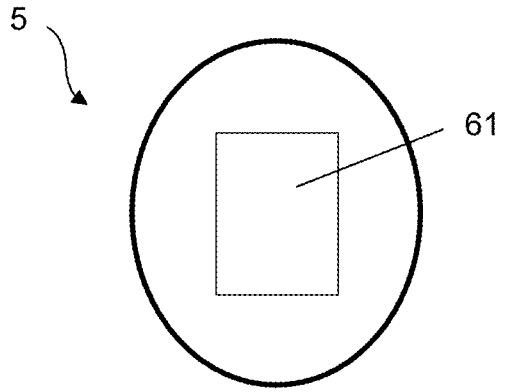
FIG. 7*b* is a bottom plan view of a liner comprising a thickened region in accordance with some embodiments of the presently disclosed subject matter.

In one embodiment, the liner can be configured such that central region 60 of the bottom face includes thickened region 61 to provide additional resistance against staining and to provide added support for waste (e.g., prevent ripping of the liner), as shown in FIGS. 7*a* and 7*b*. The same materials used to construct the liner can be used to construct thickened region 61. In some embodiments, the thickened region has a thickness that is about 0.5, 1, 1.5, 2, 2.5, 3, 3.5, 4, 4.5, or 5 times the thickness of the remainder of the liner. The thickened region also acts as a weighted area to properly position the liner during use and hold it in place. It should be appreciated that the thickened region is an optional feature.

Figure 8A:
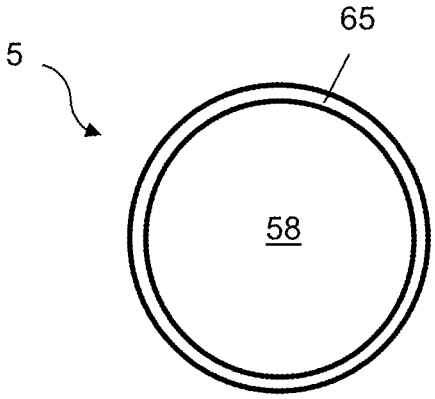
FIG. 8*a* is a top plan view of a liner comprising an adhesive ring in accordance with some embodiments of the presently disclosed subject matter.
Figure 8B:
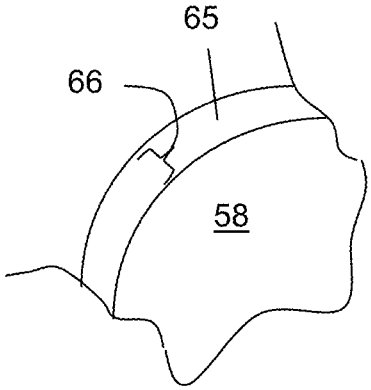
FIG. 8*b* is a fragmentary view of a liner comprising an adhesive ring in accordance with some embodiments of the presently disclosed subject matter.
Figure 9A:
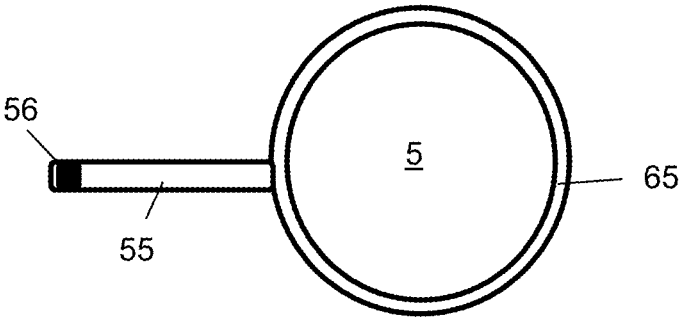
FIGS. 9*a* and 9*b* are top plan views of liners with one or more optional features in accordance with some embodiments of the presently disclosed subject matter.
Figure 9B:
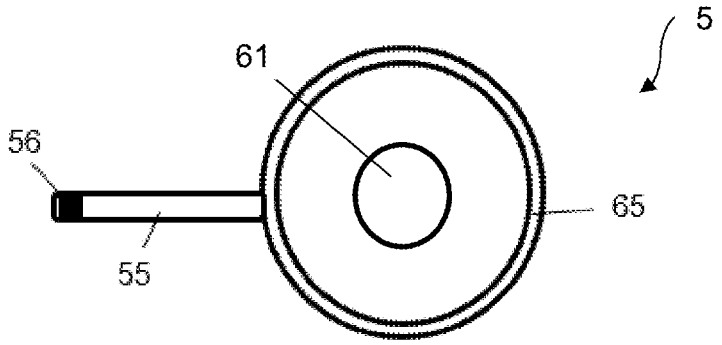

In some embodiments, the liner can include adhesive ring 65 positioned about a periphery of the liner, as shown in FIG. 8*a*. In some embodiments, the adhesive can be activated or in use once contact with water (e.g., water from within the toilet bowl) occurs. Thus, in use the liner can be positioned to initially float on the surface of the water in the toilet bowl. Once the liner sinks, the periphery of the liner will naturally contact the interior walls of the toilet bowl. As the periphery of the liner (and the adhesive ring) contacts the toilet bowl interior walls, a light bond will form to adhere the liner in proper position. The action of flushing the toilet will dislodge adhesive ring 65 from the walls of the toilet bowl, allowing it to be easily flushed, along with any captured waste. The adhesive ring can have thickness 66 of about 0.01, 0.025, 0.05, 0.075, 0.1, 0.125, 0.15, 0.175, 0.2, 0.3, 0.4, 0.5, 0.6, 0.7, 0.8, 0.9, or 1 inch, as shown in FIG. 8*b*. It should be appreciated that the variations set forth in FIGS. 8*a*-8*b* are optional features only. The liner can include an adhesive ring and/or an extension and/or thickened region as shown in FIGS. 9*a* and 9*b*.

Figure 10A:
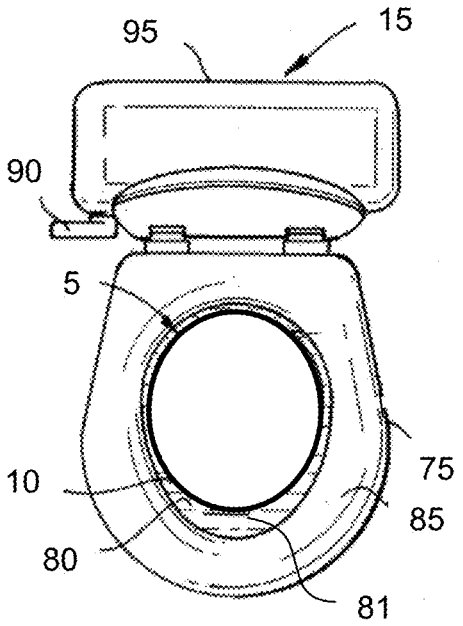
FIG. 10*a* is a top plan view of a toilet in accordance with some embodiments of the presently disclosed subject matter.
Figure 10B:
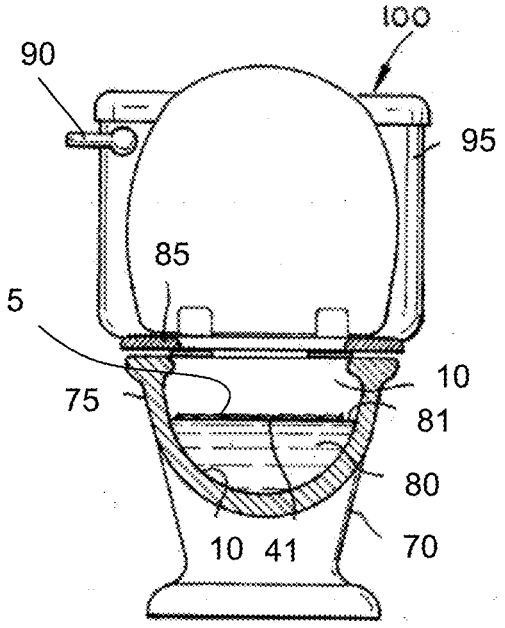
FIG. 10*b* is a front plan view of a toilet in accordance with some embodiments of the presently disclosed subject matter.

In use, the liner is positioned within the bowl of a toilet prior to using the bathroom. FIGS. 10*a* and 10*b* illustrate one example of toilet 15 for use in explaining operation of the liners. As shown, the toilet includes base 70 and bowl 75 that encloses an interior space 10 holding a volume of water 80 with surface 81. The toilet includes seat 85 that provides a resting place for a user to sit. The toilet further includes flush handle 90 that acts as an actuator for a flushing mechanism (not shown) enclosed within tank 95. It should be appreciated that toilet 15 as shown in the Figures is one example of a representative toilet that can be used. The disclosed liner can be used with any type of toilet or waste disposal system. For example, the liner may be used in toilets having older designs where the tank is suspended high above the bowl, or in new and unique designs where the seat is not oval, but elongated or round, the base is different, there is no tank (only a wall-mounted and/or electronic flushing mechanism), liquids are providing only after flushing actuation and the like.

In use, liner 5 can be positioned on the top surface of water 80 within the toilet interior. In some embodiments, the liner mimics the shape of the interior of the toilet bowl. In some embodiments, the liner is about the same size as the interior of the toilet bowl interior, as shown in FIG. 10*a*. In other embodiments, the liner is configured to be larger than the interior of the toilet bowl so that regions 6 of the liner can adhere to the sides of the bowl, as well as cover the bottom as shown in FIG. 10*b*. The user can then sit on toilet seat 85.

The user then uses the bathroom into the interior of the toilet bowl and any solid waste falls onto the top surface of the liner. Due to the weight of the waste, the liner then surrounds the waste and prevents contact between the interior of the toilet bowl and the waste. In this way, messes (e.g., staining of the toilet bowl interior) are avoided or significantly reduced.

The flushable liner therefore acts as a barrier that is flat when dry and rendered flexible when in contact with water. As solid waste is deposited onto the liner, the moisture allows the liner to wrap about the waste material in some embodiments. By doing do, the liner forms a curved or cupped shape to facilitate flushing of human waste while acting as a guard and/or shielding an interior surface a toilet bowl. The liner can then be flushed away without fear of residual waste being deposited on the toilet bowl interior surface.

Once installed in the towel bowl, the liner is partially or fully submerged within the bowl water of the toilet. The flushable material of liner 5 is adapted to remain stable after being soaked for several minutes before starting to decompose and separate. As a result, the liner maintains its integrity as a barrier between wastewater in the bowl and the bowl interior surfaces. After the toilet has been used, the user flushes the toilet and the bowl contents, along with liner 5, are flushed. Thereafter, the liner will break down and separate. Because the material is water soluble, it is suitable for septic and sewer systems. It is also contemplated that the liner will be useful in recreational vehicle waste systems.

Figure 11:
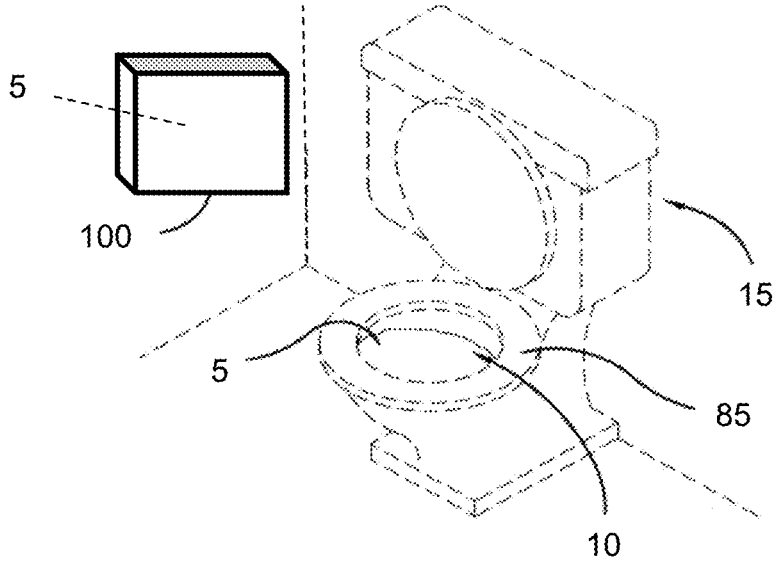
FIG. 11 is a perspective view of a bathroom comprising a liner dispensing container in accordance with some embodiments of the presently disclosed subject matter.

The liners may be provided to consumers and/or available in single sheet form or multi-sheet packaging. To this end, the liners can be provided in common bathroom settings, such as public restrooms or for use in common residential bathrooms in a wall-mounted or flat, shelf-lying dispenser. The dispensers can include container 100 configured to enclose at least one liner, as illustrated in FIG. 11.

A dispenser may have varied configurations and can be of a size suitable to hold at least one portable liner. The dispenser should define an interior space configured to hold a plurality of the liners laying in a stacked and/or connected configuration and having an opening in the dispenser from its exterior surface to its interior surface through which a user can remove at least one liner. In some instances, the liners may be folded in half or folded along a portion so that when a user pulls out one liner from the opening, the next liner is pulled into place for the next user, similar to the stacking of tissues in a tissue box.

The disclosed liner includes many advantages over current toilet systems. For example, liner 5 is configured as a simply designed toilet liner available for easy and/or portable use.

Liner 5 flushes easily, taking the waste with it to avoid leaving stains on the inside of a toilet bowl.

The disclosed liner can be easily used by a wide variety of people, from children to the elderly and requires no special training.

The disposable and biodegradable construction of liner 5 is suitable for flushing and use with a wide variety of septic or sewer systems.

The liner helps keep a toilet bowl clean from soiling due to excessive waste contact with the interior of the bowl or flushing having low water pressure and/or to avoid the need for multiple flushing.

Liner 5 may include a fragrance dispersing substance (scenting agent), which may provide a chemical scent. The scent may be emitted continuously or may be released upon contact with water. The fragrance may be beneficial in making the odors associated with the waste less noticeable. Suitable scenting agents include any additive that is intended to release an aroma prior to or during contact with water. Examples of scenting agents include scented oils, essential oils, fragrance extracts (e.g., derived from plants or herb sources), or any aroma-producing composition. Any desired fragrance can be used.

Use of liner 5 can help alleviate anxiety and embarrassment related to the use of toilet facilities.

The liner can reduce the need for manual cleaning by providing a barrier between the bowl of the toilet and solid waste. As a result, less frequent cleanings are required.

Liner 5 also reduces the noise associated with bowel movements, since the liner acts as a barrier between the water and the solid waste.

Many modifications and other embodiments of the embodiments set forth herein will come to mind to one skilled in the art to which the embodiments pertain having the benefit of the teachings presented in the foregoing descriptions and the associated drawings. Therefore, it is to be understood that the description and claims are not to be limited to the specific embodiments disclosed and that modifications and other embodiments are intended to be included within the scope of the appended claims. It is intended that the embodiments cover the modifications and variations of the embodiments provided they come within the scope of the appended claims and their equivalents. Although specific terms are employed herein, they are used in a generic and descriptive sense only and not for purposes of limitation.

What is claimed is:

1. A liner for preventing waste from contacting an interior surface of a toilet bowl, the liner comprising;

a sheet of flushable and biodegradable material defined by a top surface and an opposed bottom surface with an outer circumference extending about the sheet; and a thickened region positioned to directly contact the bottom surface of the sheet wherein the thickened region extends about a central region of the sheet through direct contact with the bottom surface of the sheet.

2. The liner of claim 1, constructed from one or more materials selected from cellulosic fibers, rayon, polyolefin, polyester, polyamide, polyaramid, polyol, polyether, polyether polyol, cotton, wood pulp, tissue, creped cellulose wadding, meltblown polymers, absorbent foams, absorbent sponges, and superabsorbent polymers.

3. The liner of claim 1, further comprising one or more odor-absorbing agents selected from baking soda, charcoal, or combinations thereof.

4. The liner of claim 1, further comprising one or more scenting agents configured to mask odors.

5. The liner of claim 1, configured in a round or oval shape.

6. The liner of claim 1, comprising a length of about 5-15 inches, a width of about 5-15 inches, and a thickness of about 0.001-0.1 inches.

7. The liner of claim 1, further comprising a plurality of pleats that extend around the outer circumference.

8. The liner of claim 1, further comprising an extension arm that extends away from a main portion of the liner, the extension arm including a distal end comprising adhesive.

9. The liner of claim 8, wherein the extension arm has a length of about 5-15 inches.

10. The liner of claim 1, further comprising a ring of adhesive positioned about the outer circumference.

11. The liner of claim 8, further comprising a ring of adhesive positioned about the outer circumference.

12. A method of reducing or preventing staining of an interior of a toilet bowl, the method comprising:

depositing the liner of claim 1 within the interior of the toilet bowl such that the liner contacts a volume of water within the toilet bowl interior;

depositing a volume of human waste within the toilet bowl interior such that the waste contacts the top surface of the liner;

wherein the liner wraps around the human waste and prevents direct contact between the human waste and the toilet bowl interior;

flushing the toilet, wherein the liner and the waste are flushed;

wherein the interior of the toilet bowl has reduced or no staining from the human waste.

13. The method of claim 12, wherein the liner emits a fragrance when contacting the volume of water within the toilet bowl interior.

14. The method of claim 12, wherein the liner initially floats on the top of the volume of water and after a period of time, sinks beneath a surface of the water.

15. The method of claim 12, wherein the liner is constructed from one or more materials selected from cellulosic fibers, rayon, polyolefin, polyester, polyamide, polyaramid, polyol, polyether, polyether polyol, cotton, wood pulp, tissue, creped cellulose wadding, meltblown polymers, absorbent foams, absorbent sponges, and superabsorbent polymers.

16. The method of claim 12, wherein the liner comprises a length of about 5-15 inches, a width of about 5-15 inches, and a thickness of about 0.001-0.1 inches.

17. The method of claim 12, wherein the liner is configured in a round or oval shape.

18. A dispensing container comprising a plurality of the liners of claim 1.

19. The liner of claim 1, wherein the thickened region has a thickness that is about 0.5, 1, 1.5, or 2 times the thickness of a remainder of the liner.

20. The liner of claim 1, wherein the thickened region is constructed from the same materials used to construct a remainder of the liner.

* * * * *